US006498830B2

(12) United States Patent
Wittry

(10) Patent No.: US 6,498,830 B2
(45) Date of Patent: Dec. 24, 2002

(54) METHOD AND APPARATUS FOR FABRICATING CURVED CRYSTAL X-RAY OPTICS

(76) Inventor: David B. Wittry, 1036 S. Madison Ave., Pasadena, CA (US) 91106

( * ) Notice: Subject to any disclaimer, the term of this patent is extended or adjusted under 35 U.S.C. 154(b) by 46 days.

(21) Appl. No.: 09/854,054

(22) Filed: May 12, 2001

(65) Prior Publication Data

US 2001/0031034 A1 Oct. 18, 2001

Related U.S. Application Data

(63) Continuation-in-part of application No. 09/250,038, filed on Feb. 12, 1999, now Pat. No. 6,236,710.

(51) Int. Cl.[7] ..... G21K 1/06
(52) U.S. Cl. ..... 378/84; 378/82
(58) Field of Search ..... 378/49, 73, 82, 378/83, 84, 85

(56) References Cited

U.S. PATENT DOCUMENTS 3,927,319 A * 12/1975 Wittry ..... 378/85
4,203,034 A * 5/1980 Carroll, Jr. ..... 378/85
4,649,557 A * 3/1987 Hornstra et al. ..... 378/84
4,807,268 A * 2/1989 Wittry ..... 378/84
4,882,780 A * 11/1989 Wittry ..... 378/84
4,949,367 A * 8/1990 Huizing et al. ..... 378/84
6,103,147 A * 8/2000 Rybicki ..... 264/325
6,285,506 B1 * 9/2001 Chen ..... 378/84

* cited by examiner

*Primary Examiner*—Drew A. Dunn

(57) ABSTRACT

A method and apparatus for fabricating x-ray optics of the type having a doubly curved crystal lamella attached to a backing plate that is positioned and aligned for use in a spectrometer, monochromator or point-focusing instrument. This method utilizes an apparatus with a removable top and a removable liner; the top containing one or more micrometer screws, and the liner being made of a material to which the bonding agent does not adhere. During fabrication of the optic by pressing the crystal against a doubly curved mold via the viscous bonding agent, excess bonding agent escapes through channels in the liner. The liner is suitably configured so that the completed optic can be easily removed and the mold and fabrication apparatus can be reused many times.

18 Claims, 5 Drawing Sheets

METHOD AND APPARATUS FOR FABRICATING CURVED CRYSTAL X-RAY OPTICS

This is a continuation in part of the application Ser. No. 09/250,038 filed on Feb. 12, 1999 titled "Curved Crystal X-ray Optical Device and Method of Fabrication" now U.S. Pat. No. 6,236,710. In the following text, application Ser. No. 09/250,038 will be referred to as the previous application.

BACKGROUND

1. Field of the Invention

This invention relates to devices having a doubly curved crystal for the diffraction of x-rays in spectrometers or instruments for microanalysis and also relates to a method of fabricating such crystal devices with high quality.

2. Prior Art

Doubly curved crystals are known to be useful as a means of focusing monochromatic x-rays or as a wavelength dispersive device in x-ray spectrometers. For example: (1) a toroidally curved crystal can provide point-to-point focusing of monochromatic x-rays, (2) crystals curved to spherical or ellipsoidal shape can be used as dispersive devices for parallel detection of x-rays, and (3) crystals with atomic planes spherically curved and the surface toroidally curved can provide high collection efficiency when used in scanning x-ray monochromators as described in U.S. Pat. No. 4,882,780.

Some of the prior art for doubly curved crystals and their mounting are described in U.S. Pat. Nos. 4,807,268, 4,780,899 and 4,949,367. U.S. Pat. No. 4,807,268 describes a curved crystal for scanning monochromators formed by plastic deformation at elevated temperature and having unique spherically curved planes and toroidally curved surface (this is sometimes called the "Wittry geometry" after its inventor). The crystals so made have low reflection efficiency and cannot focus to a high degree of accuracy because of the increase of the crystal's rocking curve width due to the plastic deformation. Subsequent work has shown that in order to preserve a crystal narrow rocking curve width, elastic, not plastic deformation must be used.

U.S. Pat. Nos. 4,780,899 and 4,949,367 describe devices which have crystals elastically bent and bonded to a smooth concave substrate by a thin layer of adhesive. These devices have a serious drawback, namely the smoothness of the crystal surface and crystal planes is strongly affected by irregularities in the bonding layer. The irregularities can result from the lack of uniform initial thickness of the adhesive layer on the substrate or it can occur during mounting of the crystal even if the initial adhesive layer is highly uniform. In addition, the use of a precision concave substrate is disadvantageous because a new substrate which must be made with great precision and expense is required for each new crystal device.

OBJECTIVES OF THE PRESENT INVENTION

The objectives of the present invention are partly as stated in the previous application, namely: (1) to provide an x-ray crystal device which can be fabricated so that the crystal is doubly curved with a smoother surface and smoother crystal planes than is obtained by other methods of fabrication, (2) to provide an x-ray crystal device whose planes are more accurately curved to a predetermined theoretically-optimum shape, (3) to obtain smaller focal spot sizes when the crystal device is used for focusing x-rays than the spot sizes previously obtained, (4) to provide a method of fabrication that will allow the fabrication of many identical crystal diffracting devices by use of only one mold, and (5) to provide a crystal device that can be aligned for use with a minimum of adjustments, and (6) to provide a crystal device which, when used in x-ray instruments, can be readily removed and replaced with minimal requirement for realignment.

Additional objectives of the present invention are as follows: (7) to provide a simpler means for obtaining the correct orientation of the crystal lamella during fabrication of the x-ray optic, (8) to provide better control of the position of the crystal lamella relative to its mounting plate during fabrication, (9) to provide for an assembly as compact as possible, and (10) to minimize the number of steps required in manufacture.

BRIEF DESCRIPTION OF THE INVENTION

This invention achieves some of the desired objectives by bonding the crystal to its substrate by a thick bonding agent that has high viscosity in it's initial state and hardens to a solid in its final state. The crystal is bent to its final state by bending it to conform to a convex mold that has the desired shape of the surface of the crystal using pressure that is applied to the crystal by the viscous bonding agent which receives pressure from a force applied to the backing plate during fabrication. Additional features of the invention include special configurations of the mold containing the surface used for bending, and special characteristics of the crystal and backing plate that make the crystal device more convenient to use and easier to align.

DETAILED DESCRIPTION OF THE INVENTION

Figure 1:
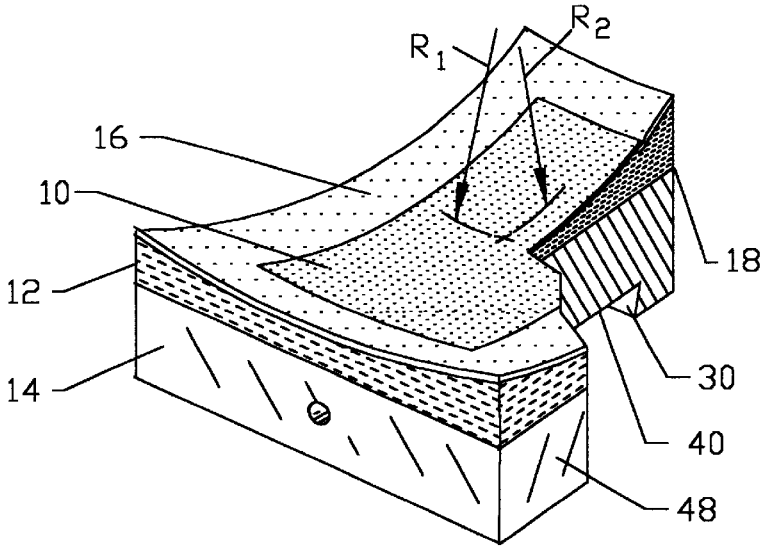
FIG. 1 shows a simple form of the invention as depicted in the previous patent application, for example: with a crystal, a thin plastic separator sheet, a thick bonding layer and a flat backing plate.

An x-ray crystal device as shown in FIG. 1 consists of a thin doubly curved crystal lamella 10, a thick bonding layer 12, and a backing plate 14. In this device, the bonding layer 12 having a thickness typically 10 to 50 times the thickness of the crystal constrains and holds the crystal to a preselected geometry. The crystal can be one of a number of crystals used in x-ray diffraction, such as mica, silicon, germanium, quartz, etc. The bonding layer consists of a material that has a high viscosity in its initial state and can be transformed by polymerization, or by a temperature change to a solid. Suitable bonding materials are thermoplastic materials, various thermosetting plastics, epoxy, low melting point glass, wax, etc. The most important property of the bonding layer is a viscosity of the order of $10^8$–$10^{10}$ Poise (c.g.s. units) before it reaches its final state. A particularly useful epoxy resin called "Torr Seal" is used in one preferred embodiment of the invention. This initially has a paste-like consistency, a viscosity of the order of $10^3$ Poise, and a pot life of 30–60 minutes. Furthermore, the low vapor pressure of this material in its cured state is desirable if the crystal device is used in a vacuum environment. Other paste types of epoxy that could be used include "plumber's epoxy" and "Milliput" epoxy putty which have physical properties similar to Torr Seal except for the low vapor pressure.

A thin plastic separator sheet 16 between a portion of the surface of the crystal near its edges lies between the crystal 10 and the bonding layer 12. This prevents the bonding material from sticking to the mold or flowing under the crystal during fabrication as will be described subsequently. Thin plastic strip with pressure sensitive adhesive coating such as "Scotch tape" or "transparent mending tape" have been successfully used for the plastic sheet with the adhesive side facing the crystal.

Figure 2:
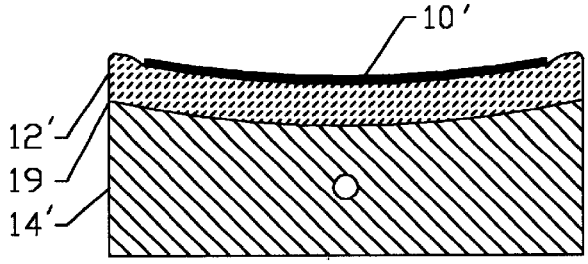
FIG. 2 shows a vertical section of a crystal device similar to the one shown in FIG. 1 with no plastic separator sheet and a backing plate with a concave bonding surface having a shape similar to the surface of the mold used for bending.

The plastic separator sheet is omitted in an alternative form of the invention shown in FIG. 2. This form of the invention is simpler than the structure shown in FIG. 1 and is feasible if the epoxy has a sufficiently high viscosity that it cannot flow under the crystal lamella. In this case, the bonding layer 12' does not extend as far beyond the crystal lamella 10', in order to minimize its sticking on the mold.

The backing plate 14 in FIG. 1 and 14' in FIG. 2 is selected of a material to which the bonding material adheres, which is dimensionally stable, and which has a coefficient of thermal expansion similar to the crystal. If the crystal to be used is transparent to light (e.g. quartz, alkali halides, etc.) it is desirable to use a transparent material for the backing plate and the bonding material so that optical interferometry can provide a means for quality control. The backing plate can be flat as indicated by reference no. 18 in FIG. 1, or it can have a concave surface as indicated by 19 in FIG. 2. The exact shape of the surface is usually not critical as will be seen in the fabrication method for a preferred embodiment that will be described.

Figure 3A:
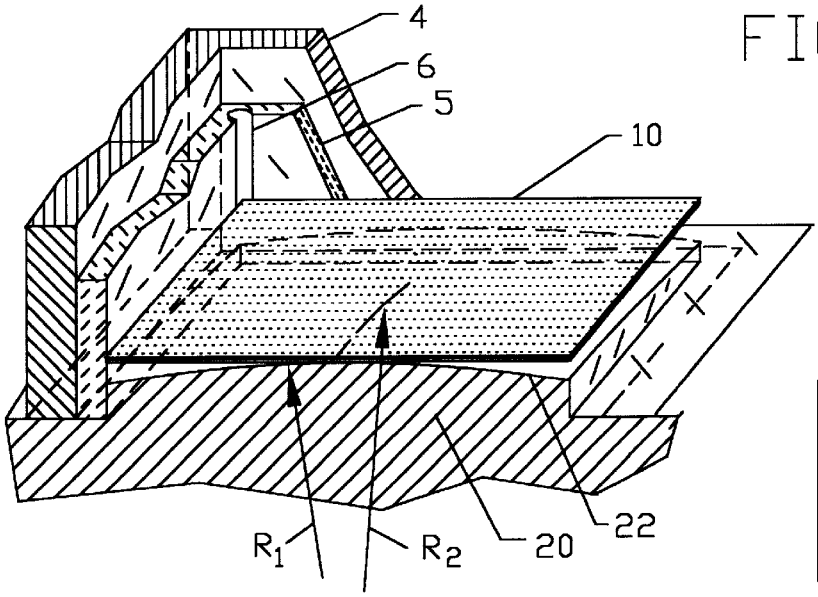
FIG. 3A shows an arrangement for aligning the crystal relative to the mold used in fabrication according to the present invention.
Figure 3B:
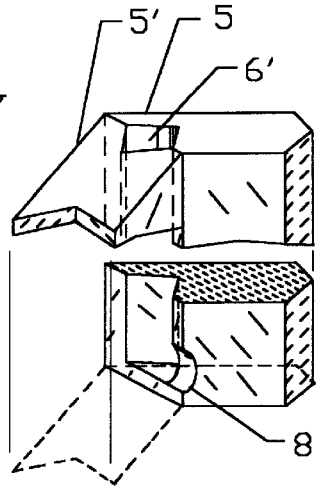
FIG. 3B shows an enlarged view of one corner of an alternative structure for the apparatus shown in FIG. 3A.

It will be noted generally, it is best to use a convex mold for bending the crystals as in U.S. Pat. No. 4,807,268. This allows for the mold to be reused and for the crystal to be conformed directly to the surface of the mold without any intervening layer, yielding high accuracy. In most cases, it is important that the crystal be properly located relative to the mold both in position and in angular orientation. In the present invention this is done with a preferred embodiment as shown in FIG. 3A and FIG. 3B. A mold 20 with polished surface 22 having two radii of curvature $R_1$ and $R_2$ in mutually perpendicular directions has an attached rigid frame 4. The frame has a liner 5 made of a substance to which the material used for bonding the crystal will not adhere. One such material is ptfe (polytetrafluoroethene), most commonly known as "teflon". While the frame 4 and liner 5 are shown here and in the subsequent figures as rectangular, they could also have an elliptical or circular shape at the line of attachment with the mold 20.

The mold liner has one or more channels, e.g. 6, to permit the escape of excess bonding material during fabrication as will subsequently be shown (re: FIG. 4C). The channels are preferably located as far as possible from the center of the surface 22, of the mold. This means that for a rectangular frame, they would be near the corners of the liner but still essentially within the liner material.

FIG. 3B shows an enlarged view of the details concerning an alternative form of the channel. Liner 5 consists of separate segments, two of which are shown as 5 and 5', to facilitate removal of the liner from the completed assembly (re: FIG. 4C). A vertical channel 6' is formed by grooves in adjacent segments. A horizontal hole 8 connects this vertical channel 6' with the lowest level that the bonding agent reaches during assembly of the x-ray optic. Since the channel 6' is isolated for the most part from the interior of the liner, the bonding agent is prevented from coming into contact with the sides of the crystal backing plate. This allows for the excess bonding agent to move into the channel in a manner that does not cause undue difficulty in removing the completed optic assembly from the frame liner.

It will be noted that the position and orientation of the crystal according to the present invention depends on utilizing a crystal lamella that fits closely inside the liner 5, 5', etc. Since the crystal lamella always requires cutting to shape, typically with a diamond saw, accurately defining its size requires no additional steps—unlike the alignment method described in the previous application. Moreover, if one or more edges of the crystal are initially in contact with the liner, the forces on the crystal during the initial bending process that would tend to break it are minimal due to the low coefficient of friction of ptfe with virtually any other material.

The fabrication method for the x-ray optic is shown in FIG. 4A through FIG. 4D. A convex mold 20 having a surface 22 of the desired shape is prepared by single point machining or by a numerically controlled milling machine.

Single point machining (e.g. with a diamond tool) is particularly suited to toroidal surfaces, i.e. surfaces of revolution having one radius of curvature in a plane perpendicular to the axis and a second radius in the plane passing through the axis. The mold surface 22 is polished to a mirror finish; hence, materials such as stainless steel, glass, or hard aluminum alloys may be used. A glass or transparent mold can also be used and would facilitate the use of interference fringes for quality control.

After the mold is prepared (by steps that are not shown here), a crystal lamella is prepared. This lamella may be flat as shown by 11 and 13 in FIGS. 5A and 5B, or cylindrical as shown by 15 and 17 in FIGS. 5C and 5D. In these figures and also FIG. 6A through FIG. 6B the thickness of the lamella is exaggerated for clarity. The actual thickness is very small and is somewhat critical in order to avoid excess strain during bending. It should preferably be no more than $1/5{,}000$ of the smallest radius of curvature, but it can be as large as $1/1000$ of this radius for crystal materials with high tensile strength. For mica, the crystal surfaces as cleaved are satisfactory, but for brittle crystals without such pronounced cleavage planes (e.g. quartz and silicon), it is important that the surfaces be damage free. This may be accomplished by etching or by chemical polishing after cutting and mechanical polishing.

Figure 4A:
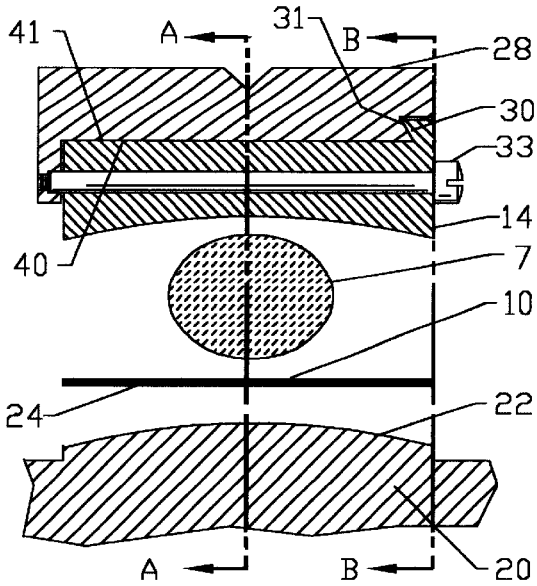
FIG. 4A shows a vertical cross section of the initial arrangement of components for fabricating of a doubly curved crystal device.

After the crystal lamella is prepared, this crystal lamella 10 is assembled together with a blob of bonding material 7, a backing plate 14 and a rectangular piston 28 in this order as shown in FIG. 4A. The actual assembly is performed inside a pressing fixture which is mounted on top of the mold shown in FIG. 4B. This pressing fixture incorporates a micrometer screw head including spindle 34 having an internal screw (not shown), scale 35, and knob 36, mounted on a removable cover plate 32 and a frame 4 with liner 5, constructed like the ones shown in FIG. 3A or FIG. 3B. This liner is preferably made in several separate pieces of ptfe (polytetrafluoroethene), to form a rectangular cavity into which the crystal fits closely.

In the first step of the assembly, placing the crystal lamella on top of the mold, it is very important to avoid the presence of even the smallest dust particles which would adversely affect the performance of the optic. If epoxy is used for the bonding agent, a blob of epoxy 7 is placed on top of the crystal 10. The backing plate 14 is attached to a piston 28 by means of a screw 33 which threads into part of the piston and pulls the projecting surface 30 on the back side of the backing plate against a mating surface 31 on the piston (refer to FIG. 4A) Due to of the slope of the surface 30, the backing plate's surface 40 is pulled snugly against surface 41 of the piston. The piston has a rectangular cross section (except for a projection into which screw 33 fits) and closely matches the rectangular cavity in the liner of the backing plate. These two components are then placed on top of the epoxy blob so that the components are in the order shown in FIG. 4A.

Figure 4B:
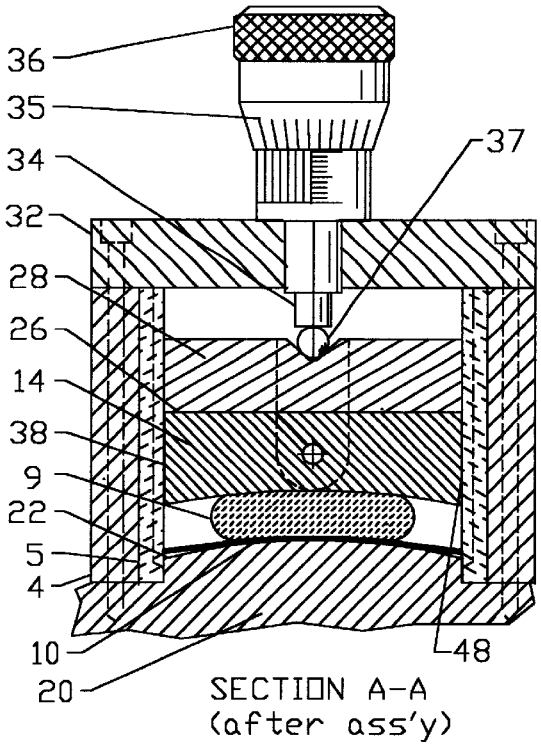
FIG. 4B shows a vertical cross section of the arrangement of components at an intermediate stage of fabrication of the doubly curved crystal device according to the present invention.
Figure 4C:
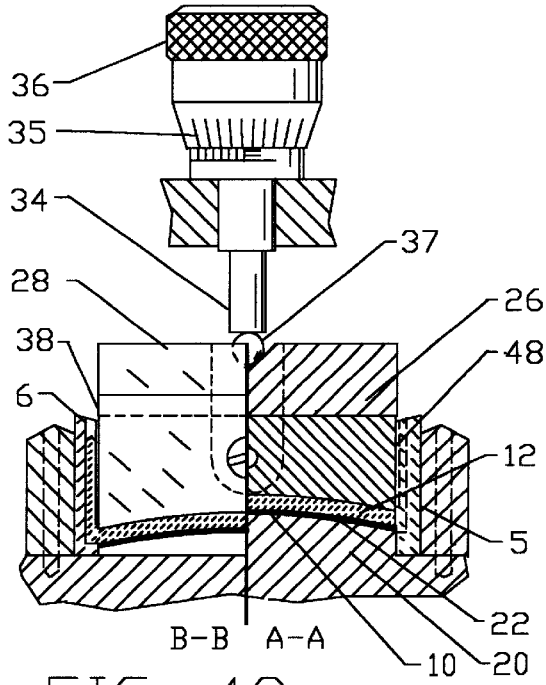
FIG. 4C shows two vertical half cross sections at positions shown in FIG. 4A of the final configuration with the crystal bent to its final shape.
Figure 4D:
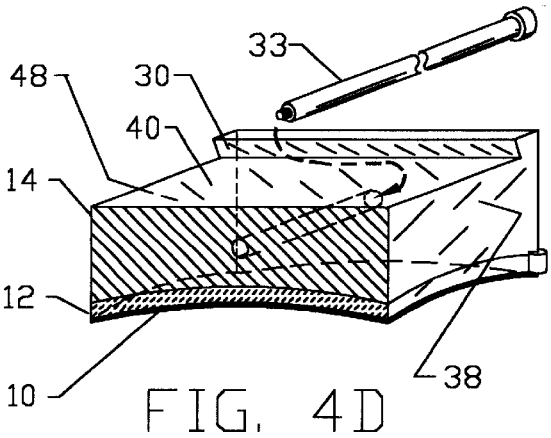
FIG. 4D shows the doubly curved crystal device after being removed from the mold.

Because of the close fit of the crystal inside the liner of the pressing fixture, the close fit of the backing plate in this liner, and the close fit of the liner in the frame of the pressing fixture, the crystal is indexed in position relative to the mold via the backing plates's lateral surfaces (e.g. 38 and 40). The assembly is compressed lightly by turning knob 36 attached to micrometer spindle 34 thereby pressing on a ball 37 resting in a depression in the piston; this causes the blob of epoxy to flatten and forces the crystal into better contact with the surface of the mold as shown in FIG. 4B. After the epoxy has partly polymerized, the pressure on the backing plate 14 is gradually increased by further moving of the micrometer spindle 34 so as to force the lower surface 24 of the crystal 10 into intimate contact with the upper surface 22 of the mold 20 as shown in FIG. 4B.

During this process, if the backing plate and the crystal are transparent, contact between the crystals surface 24 and the mold surface 22 can be monitored by observing interference fringes with illumination by light through the surface 26 of the backing plate 14. Alternatively, such fringes can also be observed by light passing through the mold if it is transparent. Dust particles, or undesirable penetration of the bonding material between the crystal and the mold can be observed by optical interference fringes in this case. In addition it will be possible to observe cracking of brittle crystals if this happens to occur. However, it should be noted that as long as the pieces of the crystal remain in the proper position, cracking of the crystal will not affect the performance of the device significantly. The present method of orienting and bending the crystal increases the probability that the pieces of a broken crystal will remain in the correct position.

When the epoxy completely fills the space between the crystal and the backing plate, and before the epoxy hardens completely, the knob 36 of the micrometer spindle 34 is moved to a predetermined setting as gauged by the micrometer scale 35 and then held at this setting. If a quantity of epoxy used was slightly more than that required, the excess bonding epoxy would be squeezed into the channels 6. In this way, the crystal's surface is positioned as close as possible to a predetermined distance from the backing plate. This procedure gives greater accuracy because it provides for a margin of error which would not be present with other methods of determining the crystal to backing plate distance, for example, by trying to use a precise quantity of bonding material. After the epoxy hardens completely, the assembly is removed from the mold, from the liner of the pressing fixture and from the pressing fixture. Finally the backing plate with crystal attached is removed from the piston, yielding the result shown in FIG. 4D.

It should be noted that use of parting agents to prevent adhesion of the bonding material to the mold is not desirable because the presence of these agents will reduce the accuracy with which the crystal conforms to the desired shape. However, parting agents may be used to prevent the epoxy from sticking to the pressing fixture or the sides of the backing plate.

It should also be noted that, while the forgoing procedure involves a single micrometer screw, three micrometer screws could be used instead. In some cases this might be preferable, because if the epoxy blob is initially off center, the asymmetric forces would tend to tilt the backing plate. But if three screws were used, moving each screw sequently and by a small amount would allow the crystal backing plate,to be moved along a line parallel to a normal to the surface 22 without significant tilting. Finally, because of the use of the micrometer screw(s) and the resulting positioning accuracy, the final x-ray optic requires less in situ adjustments when it is used in x-ray optical instruments. Detailed description of one application will elucidate this point.

Figure 7A:
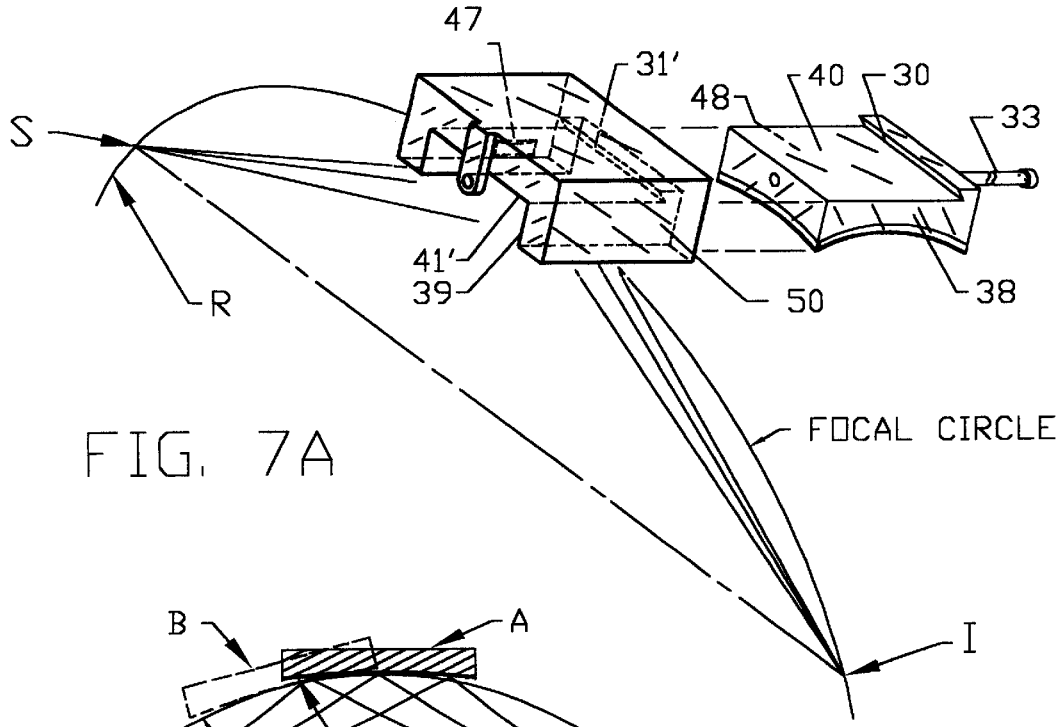
FIG. 7A shows a toroidal crystal device with the property of point-to-point focusing.

One of the most important applications of this invention is that of focusing x-rays of a particular wavelength from a source to form an x-ray microprobe. This type of device with point-to-point focusing property is illustrated in FIG. 7A. The crystal in this device has a toroidal shape such that the crystal satisfies either the Johann or Johansson geometry in the plane of the Rowland circle and also has axial symmetry over its lateral extent about the line joining the source S and the image I.

Figure 5A:
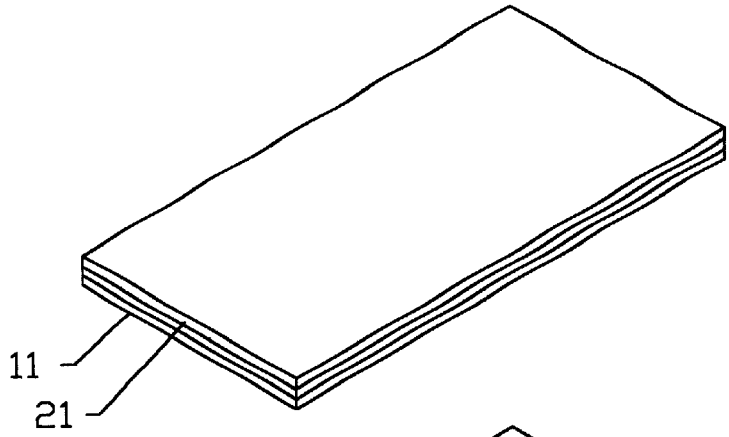
FIG. 5A shows a flat crystal lamella with atomic planes 21 parallel to the large surface of the lamella 11.
Figure 5B:
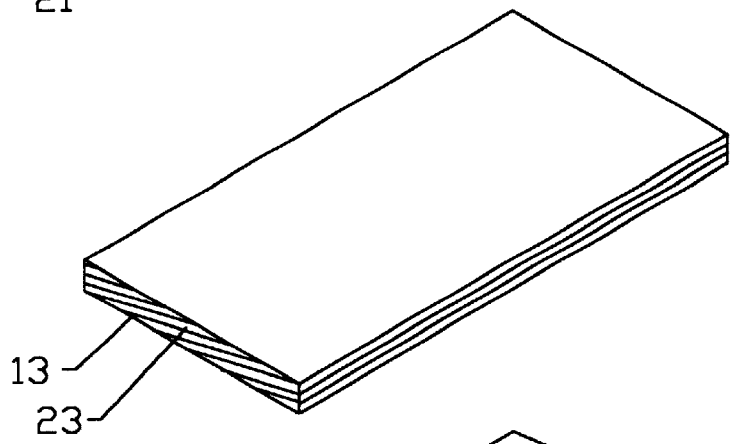
FIG. 5B shows a flat crystal lamella with atomic planes 23 making an angle with respect to the large surface of the lamella 13.
Figure 6A:
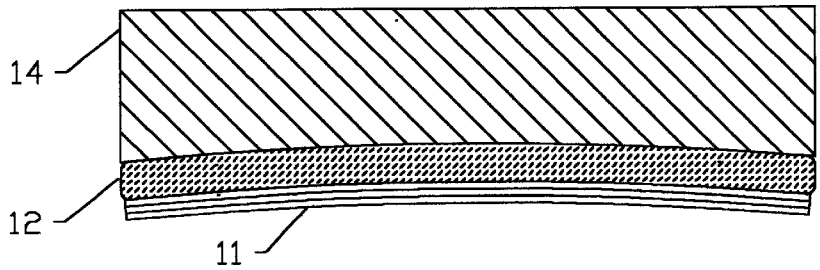
FIG. 6A shows a vertical cross section of a doubly curved crystal device made by using the crystal lamella of FIG. 5A.
Figure 6B:
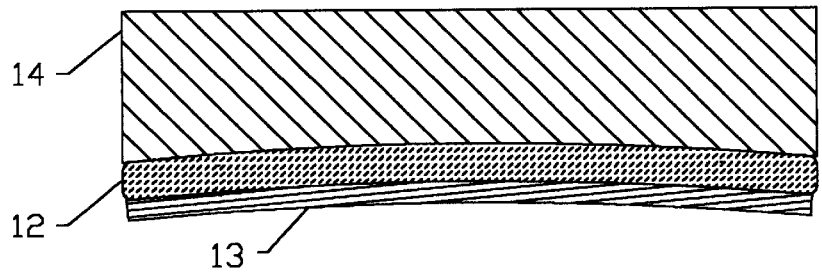
FIG. 6B shows a vertical cross section of a doubly curved crystal device made by using the crystal lamella of FIG. 5B.

If a crystal lamella like the one shown in FIG. 5A is used, having crystal planes 21 parallel to the surface 11 and the mold has a radius of $2R_1$ in the plane of the focal circle having a radius $R_1$, the result after bending will be as shown in FIG. 6A and the geometry in the plane of the focal circle after alignment will be the Johann geometry. In this case, the crystal device will be in the usual symmetric position A relative to the Source S and the Image I shown in FIG. 7B. On the other hand, if the crystal lamella of FIG. 5B is used with the crystal planes 23 making an angle with respect to the large surface 13 of the lamella, and the mold has a radius of $2R_1$ in the plane of the focal circle of radius $R_1$, the result after bending will be as shown in FIG. 6B. Then, the geometry in the plane of the focal circle after alignment with respect to the source S and the image I will be similar to the Johann geometry but with the crystal device offset from the symmetric position as shown by position B in FIG. 7B.

Figure 5C:
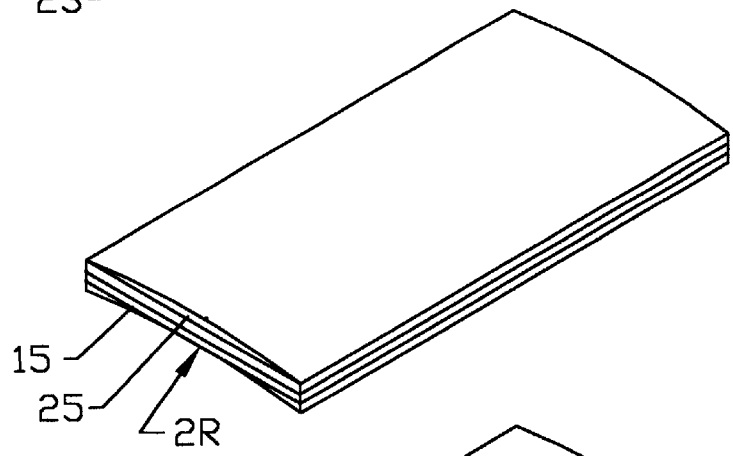
FIG. 5C shows a cylindrically curved crystal lamella with atomic planes 25 tangent to the surface of the lamella 15 along a midline.
Figure 5D:
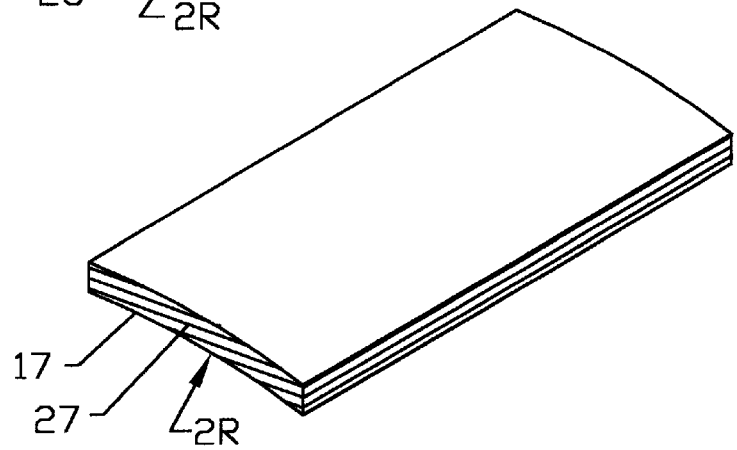
FIG. 5D shows a cylindrically curved crystal lamella with atomic planes 27 making an angle with the surface of the lamella 17.
Figure 6C:
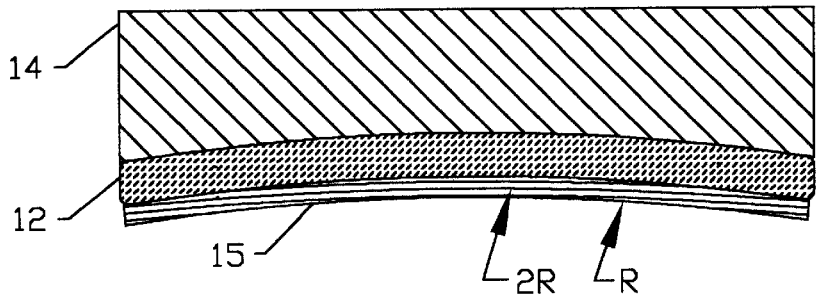
FIG. 6C shows a vertical cross section of a doubly curved crystal device made by using the crystal lamella of FIG. 5C.
Figure 6D:
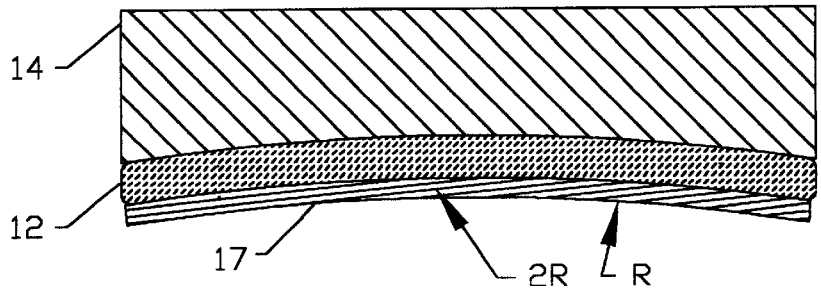
FIG. 6D shows a vertical cross section of a doubly curved crystal device made by using the crystal lamella of FIG. 5D.

Two different Johansson geometries are obtained if the crystal lamella is curved to a radius $2R_1$ as shown in FIG. 5C and FIG. 5D. Like their 2-dimensional analog, Johansson-based point-to-point focusing devices will provide greater solid angle of collection and also more exact focusing than Johann-based devices. They are particularly advantageous when used with crystals having a small rocking curve width. When the crystal planes 25 are parallel to the surface 15 of the crystal at its mid-line as shown in FIG. 5C, the result after bending to a mold with radius $R_1$ is shown in FIG. 6C. This crystal device when aligned with respect to source S and image I will be in the symmetric position C shown in FIG. 7C. But if the crystal planes 27 make an angle with respect to the surface 17 as shown in FIG. 5D, the result after bending to a mold with radius $R_1$ would be as shown in FIG. 6D. Then, when the crystal device is properly aligned, it will be asymmetric relative to S and I, as shown by position D in FIG. 7C.

The alignment of the crystal devices relative to the Source S and Image I can be accomplished by a device similar to one described in U.S. Pat. No. 5,892,809 which is hereby incorporated by reference. For this purpose, it is important to have indexing features on the crystal device so that its position relative to the source and image can be roughly preset and also only adjustments that are absolutely necessary need to be accommodated. The initial positioning is facilitated by the mounting fixture 50 of FIG. 7A having a U shape with the space between the arms of the U configured to match the backing plate. The backing plate with crystal is attached to fixture 50 by screw 33 like it had been previously attached to the piston. A leaf spring 47 maintains contact of surface 38 of the backing plate with surface 39 of 50 before 33 is fully tightened and contact of surface 40 of the backing plate and 41' of 50 is maintained when 33 is fully tightened. Thus, the position of the crystal is now fixed relative to the fixture 50, as it was previously fixed relative to the mold 20. Details of the degrees of freedom for which adjustments might be provided as well as a simple mechanism for adjustment of the others are given in the reference cited.

Figure 7B:
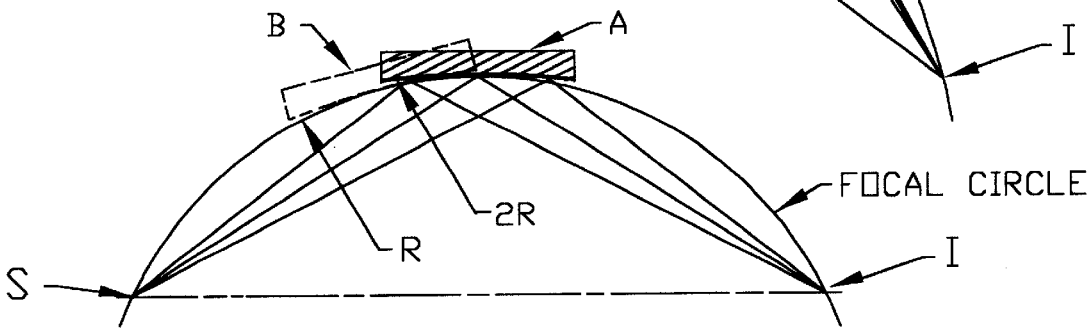
FIG. 7B shows a cross section of a toroidal crystal device with point-to-point focusing based on the Johann geometry.
Figure 7C:
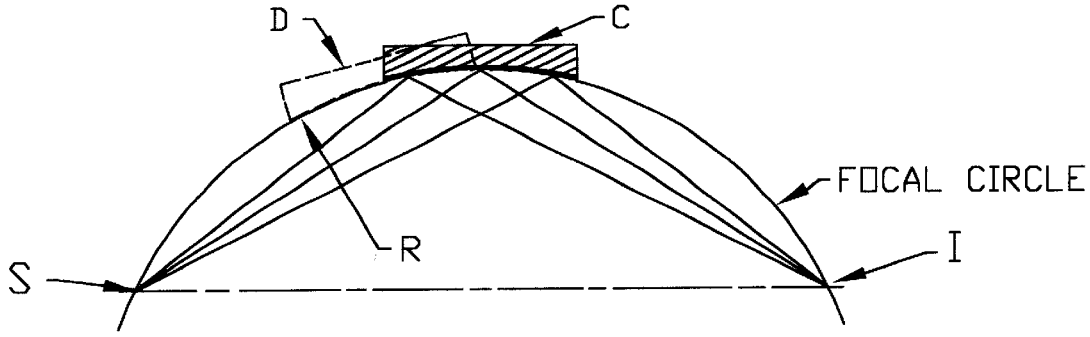
FIG. 7C shows a cross section of a toroidal crystal device with point-to-point focusing based on the Johansson geometry.

While the asymmetric cases shown in FIGS. 7B and 7D show the crystal device closer to the source than to the image, clearly the opposite situation case could be achieved (i.e. crystal device closer to the image than to the source). The asymmetric cases are sometimes useful to provide additional space in the x-ray source region or image region.

DISCUSSION AND RAMIFICATIONS

An x-ray crystal device according to this invention provides a doubly bent crystal that accurately conforms to a theoretically optimum shape and provides better performance than similar crystal devices made according to the prior art. Moreover, the methods of fabrication allow for the production of many identical crystal devices from the same mold, thus reducing the cost of the each device.

The first monochromatic x-ray microprobe that had sufficient intensity for trace element determination in x-ray fluorescence analysis and was based on a laboratory source was developed using an x-ray crystal device similar to the one described herein (re: papers by Z. W. Chen and D. B. Wittry, "Monochromatic microprobe x-ray fluorescence— . . . J. Appl. Phys. vol. 84, pp. 1064–73, 1998, and "Microprobe x-ray fluorescence . . . Appl. Phys. Lett. vol. 71, 1997, pp. 1884–6). The device used in the cited work was based on a Johann geometry with focal circle radius of about 125 mm with a mica crystal having an effective area of approximately 8 mm×28 mm and produced an x-ray spot size of about 50 $\mu$m with an x-ray source of about 20 $\mu$m.

An indication of the advantages of some of the features of the present invention can be obtained by comparing the theoretical performance of some examples of specific crystal devices with the Johann-based mica diffractor used by Chen and Wittry. If a silicon (111) crystal were used and the values of the rocking curve width of $8.7\times10^{-5}$ radian (instead of $30\times10^{-5}$) and peak reflectivity of 0.7 (instead of 0.2 for mica) are assumed, then, with the Johann-based geometry, the broadening of the focal spot due to the crystal's rocking curve would be about 8.7 $\mu$m instead of 30 $\mu$m as it was for the mica crystal. The effective crystal width would be $8\times(8.7/30)^{0.5}=4.31$ mm for the Johann-based geometry—but we must note that for copper K alpha radiation and a Si crystal, the penetration of the rays into the crystal is sufficient that there would be little distinction between this geometry and the Johansson geometry. This distinction becomes more evident if we consider wider crystals, for example 16 mm, or more strongly absorbed radiation.

The peak reflectivity for the Si crystal is about 3.5 times higher than that of mica, so, if equal widths are considered, the total flux of the focused probe could be the same if the Gaussian image size were smaller by $(1/3.5)^{0.5}=(1/1.87)$, yielding a spot size of $(20/1.87)+8.7=19.4$ $\mu$m vs $(20+30)=50$ $\mu$m. But, if a Johansson-based crystal were used having a width of 16 mm the corresponding Gaussian image would be 7.6 $\mu$m, yielding a spot size of $7.6+8.7=16.3$ $\mu$m and then the number of photons/sec/cm$^2$ would be greater than that which was obtained with mica by a factor of approximately $(50/16)^2=9.76$.

In order to make smaller spots, it is important to reduce the broadening due to the rocking curve width. But as this gets smaller, it is no longer possible to utilize all of the characteristic line's natural width. The intensity loss resulting from focusing only part of the characteristic line can be estimated as follows: Bragg's law is: $n\lambda=2d\sin\theta$ where $\theta$ is the Bragg angle. Differentiating Bragg's law on both sides and dividing by Bragg's law, we obtain:

$$(\Delta\lambda/\lambda)_B=(1/\tan\theta)\Delta\theta$$

where $\Delta$ is the rocking curve width. Assuming that the characteristic line has $(\Delta\lambda/\lambda)_L=2\times10^{-4}$ and assuming values for Cu K radiation and the (111) reflection from silicon, we obtain:

$$(\Delta\lambda/\lambda)_B/(\Delta\lambda/\lambda)_L=8.7\times10^{-5}/(\tan 14.21)\times2\times10^{-4}=1/1.71$$

Thus the rocking curve width for the Si (111) crystal would appear to be reasonably well matched to focus nearly all the characteristic x-ray line.

One can calculate similarly the results of using a crystal with even narrower rocking curve width e.g. α quartz (2243) with a rocking curve of about $5\times10^{-6}$ radian. This would yield image broadening due to the rocking curve width of only about 0.5 μm. Then, the loss of intensity due to not using all of the natural line width is more serious. For this case and copper K radiation we would obtain:

$$(\Delta\lambda/\lambda)_B/(\Delta\lambda/\lambda)_L=5\times10^{-6}/(\tan 49.64)\times2\times10^{-4}=1/46.8$$

In order to offset this effect, it is clearly desirable to use the Johansson-based geometry and wider crystals. Also one should use higher voltage for the x-ray source since the intensity of characteristic lines increases as the 1.63 power of the voltage above the critical excitation voltage (for copper K radiation this would be approximately 3× if 50 kV instead of 30 kV were used). For this case the total number of photons/sec in a 10 μm spot formed by the quartz crystal would be lower than that obtained in a 16 μm spot with a Si crystal by a factor of $(9.5/7.6)^2\times(3/46)\approx0.1$.

Thus, by using all available techniques, it should be possible to obtain focal spot sizes significantly less than 10 μm with adequate intensity for x-ray fluorescence analysis, although the detection limits would be lower for a given measurement time than those obtained for larger spot sizes. Note that in our calculations we have assumed for simplicity that the number of photons/sec in the Gaussian image is proportional to the square of its diameter, which would be the case for an aperture of fixed size in the electron beam forming the x-ray source. It is well known that if the aperture size is optimized, the current on a spot of diameter d is proportional to $d^{8/3}$.

We should also note that while it might appear that rocking curves as small as $5\times10^{-6}$ would make it seem hopeless to align a doubly curved diffractor properly, the natural width of the characteristic x-ray line would in fact allow such an alignment to be done. In any case, it is important that it be possible to preset the position and orientation of the crystal device to as high a degree as possible—otherwise obtaining proper alignment not only requires a costly alignment fixture and a lot of time, but could be like looking for the proverbial "needle in a haystack".

The features of the present invention including the possibility of fabricating Johansson-based doubly curved crystal devices and prepositioning them relative to a source and image position are vitally important for future developments in X-ray microprobe technology.

I claim:

1. An apparatus for fabricating curved crystal x-ray optics that have a doubly curved crystal lamella attached to a backing plate by a bonding agent, said apparatus comprising the following:

a mold with doubly curved surface, a frame attached to said mold, a liner closely fitting inside said frame to which said bonding agent will not adhere, said liner being a close fit to the crystal lamella and having channels for the escape of excess bonding agent, a removable top for said frame, said top having at least one micrometer screw having a position indicating scale.

2. An apparatus as described in claim 1 wherein said top has three micrometer screws with position indicating scales.

3. An apparatus as described in claim 1 wherein said liner consists of polytetrafluoroethene.

4. An apparatus as described in claim 1 wherein said bonding agent is a thermosetting plastic.

5. An apparatus as described in claim 1 wherein said bonding agent is an epoxy resin.

6. An apparatus as described in claim 1 wherein said bonding agent is a thermoplastic material.

7. An apparatus as described in claim 1 wherein said bonding agent is a wax.

8. A method of fabricating an x-ray optic consisting of the following steps:

a) preparing a suitable doubly curved convex mold, b) preparing a suitable crystal lamella, c) preparing a suitable apparatus attached to said mold and comprising a frame, a liner to which the bonding agent to be used for attaching the crystal will not adhere, said liner containing a cavity for the crystal, for a crystal backing plate, and for a piston fitting closely inside said cavity, said frame having a cover plate containing at least one micrometer screw, d) preparing a suitable backing plate, said backing plate having suitable surfaces as needed for indexing the position of the backing plate relative to said piston in said apparatus, e) affixing said backing plate to said piston, f) assembling said convex mold with said crystal lamella, a blob of bonding agent, said backing plate and said piston inside said pressing fixture in this order while cover plate is not present, g) attaching said cover plate to said frame of step (c) and turning said micrometer screw to bring components assembled in step (f) into preliminary state of contact, h) allowing initial setting of the bonding material, i) turning said micrometer screw to a predetermined setting, j) allowing bonding material to reach its final hardened state, k) removing the bonded assembly from the said pressing fixture, mold, and said piston.

9. A method for fabricating a curved crystal x-ray optic as described in claim 8 wherein said blob of bonding agent in step (f) consists of a thermosetting plastic.

10. A method,for fabricating a curved crystal x-ray optic as described in claim 8 wherein said blob of bonding agent in step (f) consists of an epoxy resin.

11. A method for fabricating a curved crystal x-ray optic as described in claim 8 wherein said blob of bonding agent in step (f) consists of a thermoplastic material.

12. A method for fabricating a curved crystal x-ray optic as described in claim 8 wherein said blob of bonding agent In step (f) consists of a wax.

13. A method for fabricating a curved crystal x-ray optic as described in claim 8 wherein said liner in claim (c) is made of polytetrafluoroethene.

14. A method for fabricating a curved crystal x-ray optic as described in claim 8 wherein said cover plate of step (c) contains three micrometer screws that are sequently adjusted in step (i) in small increments to achieve a final state in which all three screws have the same position indication.

15. An x-ray optic utilizing a doubly curved crystal bonded to a backing plate and fabricated by a suitable apparatus such that said backing plate can be interchangeably located in two positions, namely, (1) in said apparatus for fabrication and (2) in an instrument having an x-ray source in which said optic is used for the purpose of x-ray spectrometry or x-ray imaging, said apparatus having at least one micrometer screw with position indicating scale and means for locating said backing plate in three angles and two directions not parallel to the axis of said screw, and said instrument having means for prepositioning said backing plate relative to said x-ray source in three directions and three angular coordinates.

16. An x-ray optic as described in claim 15 wherein said apparatus for fabrication contains three micrometer screws with position indicating scales.

17. An x-ray optic as described in claim 15 wherein said means for locating said backing plate said apparatus in two directions not parallel to the axis of said screw includes two planar intersecting surfaces.

18. An x-ray optic as described in claim 15 wherein means for prepositioning said backing plate in said instrument includes three planar intersecting surfaces.

* * * * *